US011060210B2

(12) United States Patent
Doerner et al.

(10) Patent No.: US 11,060,210 B2
(45) Date of Patent: Jul. 13, 2021

(54) METHOD FOR OPERATING A SERVICE UNIT

(71) Applicant: Saurer Spinning Solutions GmbH & Co. KG, Uebach-Palenberg (DE)

(72) Inventors: Wolfgang Doerner, Moenchengladbach (DE); Philipp Schiffers, Erkelenz (DE); Jonathan Sprecher, Aachen (DE); Harald Wassen, Schwalmtal (DE)

(73) Assignee: Saurer Spinning Solutions GmbH & Co. KG, Uebach-Palenberg (DE)

( * ) Notice: Subject to any disclaimer, the term of this patent is extended or adjusted under 35 U.S.C. 154(b) by 98 days.

(21) Appl. No.: 16/217,779

(22) Filed: Dec. 12, 2018

(65) Prior Publication Data

US 2019/0177884 A1 Jun. 13, 2019

(30) Foreign Application Priority Data

Dec. 13, 2017 (DE) ..... 10 2017 129 700.6

(51) Int. Cl.
*D01H 9/10* (2006.01)
*D01H 4/50* (2006.01)

(52) U.S. Cl.
CPC ..... *D01H 9/10* (2013.01); *D01H 4/50* (2013.01)

(58) Field of Classification Search
CPC ..... D01H 9/10; D01H 4/50
See application file for complete search history.

(56) References Cited

U.S. PATENT DOCUMENTS 4,865,260 A * 9/1989 Colli ..... B65H 67/068 242/473.6
5,237,807 A * 8/1993 Iwade ..... D01H 13/145 188/158

(Continued)

FOREIGN PATENT DOCUMENTS

DE 44 43 818 A1 6/1996
DE 199 05 856 A1 8/2000

(Continued)

OTHER PUBLICATIONS

European Search Report for corresponding European Patent Application No. 18210557.7 dated Apr. 24, 2019; all enclosed pages cited.

*Primary Examiner* — Shaun R Hurley
(74) *Attorney, Agent, or Firm* — Nelson Mullins Riley & Scarborough LLP

(57) ABSTRACT

Method for operating a service unit for processing work orders regarding a cross-wound package/empty tube doffing process employed at spinning machines producing take-up packages that process at least two different lots, whereby the service unit is fed an empty tube via the spinning machine's tube feed track, and the fed empty tube is taken up by the service unit. If the current work order for the cross-wound package/empty tube doffing of the workstations expires before it is processed and the empty tube is exchanged and another work order has come in which is for a workstation requiring a cross-wound package/empty tube doffing for another lot, the already taken up empty tube is released by the service unit, and the service unit takes up an empty tube of another lot in order to be able to carry out a cross-wound package/empty tube doffing process at the other workstation.

7 Claims, 3 Drawing Sheets

(56) References Cited

U.S. PATENT DOCUMENTS

| | | | | |
|---|---|---|---|---|
| 5,634,602 | A * | 6/1997 | Gobbels | B65H 54/343 242/125.1 |
| 5,937,629 | A | 8/1999 | Spindler et al. | |
| 6,056,228 | A * | 5/2000 | Resch | B65H 49/38 242/473.6 |
| 6,272,833 | B1 * | 8/2001 | Stephan | B65H 67/0417 57/266 |
| 7,412,818 | B2 * | 8/2008 | Doerner | B65H 67/068 57/268 |
| 9,631,299 | B2 * | 4/2017 | Maleck | D01H 13/145 |

FOREIGN PATENT DOCUMENTS

| | | |
|---|---|---|
| DE | 10 2007 056561 A1 | 2/2009 |
| EP | 0 262 726 A2 | 4/1988 |

* cited by examiner

METHOD FOR OPERATING A SERVICE UNIT

CROSS-REFERENCE TO RELATED APPLICATIONS

This application claims priority from German National Patent Application No. DE 10 2017 129 700.6, filed Dec. 13, 2017, entitled "Verfahren zum Betreiben eines Service-aggregates", the entire contents of which are incorporated herein by reference.

FIELD OF THE INVENTION

The invention comprises a method for operating a service unit for processing work orders regarding a cross-wound package/empty tube exchange as well as a spinning machine producing take-up packages with at least one traversable service unit running along the workstations.

BACKGROUND OF THE INVENTION

In connection with open-end spinning machines, service units are known in various embodiments and are described in numerous texts in the patent literature.

For example service units are used in the application that are designed as piecer carriages. Such piecer carriages are used in open-end spinning machines both for when their workstations require help with a "normal" yarn break as well as with cross-wound package/empty tube doffing.

Moreover, service units that work as doffing and cleaning carriages are also known. Such doffing and cleaning carriages serve open-end spinning machines that have workstations that are autonomous to a large extent. The workstations of such open-end spinning machines each have, in addition to a spinning device for preparing a yarn and a winding device for producing a cross-wound package, further functional elements which enable the workstations to piece themselves up immediately following a yarn break. Such workstations therefore only require the help of a traversable service unit if the workstation is to be cleaned or if a cross-wound package/empty tube doffing is required at one of the workstations.

Such a cross-wound package/empty tube doffing is usually carried out if the cross-wound package at one of the workstations has reached its prescribed diameter or yarn length and must be exchanged for a new empty tube. A so-called work order is issued by the workstation, upon receipt of which the service unit travels to the corresponding workstation and positions itself in front of it. An empty tube is requested and transported via an empty tube feed track to the service unit at the workstation. The full cross-wound package is removed from the package cradle of the relevant workstation by the service unit and transferred to the spinning machine's cross-wound package transport device. The service unit also has a gripping device with which the delivered empty tube is removed from the tube feed track and inserted into the package cradle. Finally, the service unit ensures that the open-end winding device is newly pieced up using a so-called auxiliary yarn and the new yarn is affixed to the empty tube which was previously inserted into the package cradle. In this way the work order is processed by the service unit and the service unit is available for the next work order, such as for processing another cross-wound package/empty tube doffing process.

For multi-lot operation of the open-end spinning machine, different empty tubes are usually used for different lots, and for this reason the optimal scheduling of requirements for empty tubes is difficult. As soon as a work order of a workstation regarding a cross-wound package/empty tube doffing is received, the corresponding empty tube is transported to the workstation, and therefore to the service unit and is taken up by the service unit using the gripping device and inserted into the package cradle. If the work order expires however, for example because the workstation experiences a disruption as a result of which the empty tube remains in the gripping device, the service unit can only serve a workstation that is processing the same lot and therefore requires the same empty tube. However, if there is no such work order from the same lot, the service unit cannot carry out a cross-wound package/empty tube doffing at any other workstation, even if one or more other workstations have issued work orders to this effect. Delays arise as a result which can lead to undesired long stoppages of workstations.

German Patent Publication DE 199 05 856 A1 discloses an open-end spinning machine which has many workstations between its end sections. These workstations are supplied by several service units during operation. If a cross-wound package has now reached its prescribed diameter at one of the workstations, it is exchanged for an empty tube. This means that the service unit travels, for example upon being notified by the central machine control unit, to the affected workstation and locks into place there. The service unit, which always carries an empty tube with it in its own storage space, first removes the completed cross-wound package from the package cradle and transfers it to the cross-wound package transportation device positioned behind the workstations. Then the service unit puts the empty tube it has brought with it into the package cradle of the affected workstation. The service unit has also issued a tube request at the beginning of the doffing cycle. This means that an instruction to promptly send a tube to the area of the workstation at which the service unit is currently working is issued to the tube delivery device.

Through German Patent Publication DE 44 43 818 A1 service units that are used without such a storage space are also known. For a cross-wound package/empty tube doffing at a workstation, a service unit is requested and positioned at the workstation. A tube is requested from the tube magazine which is transported to the workstation using a tube feed track. After the cross-wound package is removed from the package cradle, the service unit takes the delivered tube from the tube feed track using the gripping device and inserts this into the package cradle.

SUMMARY OF THE INVENTION

An initial aspect of the invention comprises therefore a method for operating a service unit for processing work orders regarding a cross-wound package/empty tube doffing process which is employed at spinning machines producing take-up packages that process at least two different lots, whereby in an initial method step the service unit is fed an empty tube via the spinning machine's tube feed track, and in a second method step the fed empty tube is taken up by the service unit.

The method is characterized in that, if the current work order for the cross-wound package/empty tube doffing of the workstations expires before it is processed and the empty tube is exchanged and another work order has come in which is for a workstation requiring a cross-wound package/empty doffing for another lot, in a third method step the already taken up empty tube is released by the service unit, and in a fourth method step the service unit takes up an empty tube of another lot in order to be able to carry out a cross-wound package/empty tube doffing process at the other workstation.

This procedure ensures that, except when it is processing a work order at a workstation, the service unit is always available for the processing of work orders. In this way necessary cross-wound package/empty tube doffing processes can be carried out directly, because the service unit cannot be blocked by an empty tube that it cannot change. This is particularly significant for multi-lot operation, in order to minimize unnecessary stoppage times of individual workstations that are waiting on a cross-wound package/empty tube doffing. This not only improves the efficiency of each individual service unit, but also optimizes the overall machine efficiency.

If a work order regarding a cross-wound package/empty tube doffing comes in, the service unit travels to the affected workstation and the empty tube required for this lot is requested and transported to the service unit or workstation via a tube feed track. The cross-wound packages that are to be doffed and that are usually full are removed from the package cradle by the service unit and transferred to the spinning machine's cross-wound package transportation device, this is carried out with, for example, a frame opener integrated into the service unit combined with a take-off and drive arm. With a gripping device that is also positioned in the service unit, the empty tube is removed from the tube transport track and inserted into the package cradle.

In practice, however, it can occur that the work order expires before the empty tube can be inserted into the package cradle by the service unit. This can occur, for example, if the workstation stops or the current work order is deleted prematurely due to the manual intervention of operating personnel. In this case, the empty tube previously remained in the gripping device of the service unit, blocking it. The service unit had to wait until a work order for a cross-wound package/empty tube doffing for the same lot came in in order to be able to empty the gripping device and insert the empty tube, even if in the meantime workstations processing other lots reported requests for cross/wound package/empty tube doffing. Because in such a case, in accordance with the invention the service unit can release the empty tube that is already in the gripping device again, it is then immediately able to carry out a work order for a cross-wound package/empty tube doffing which is necessary at another workstation that is processing another lot and therefore requires another empty tube.

In an advantageous embodiment, the empty tube released by the service unit is laid back onto the tube feed track.

The empty tube available in the gripping device of the service unit can be laid back onto the tube feed track if the current work order expires before the empty tube could be inserted into the package cradle at the corresponding workstation. Then the empty tube is transported away via the tube feed track and the service unit can promptly carry out a new work order for a cross-wound package/empty tube doffing.

Alternatively, the empty tube given up by the service unit is inserted into a storage device.

Instead of putting the empty tube back onto the tube feed track, the empty tube can also be inserted into a storage device. Within the context of the invention, it is conceivable that this storage device is located either inside or outside of the service unit. It is essential that the gripping device of the service unit can insert the empty tube into the storage device, so that the service unit is ready for use for the next cross-wound package/empty tube doffing without delay.

Preferably, the empty tube inserted into a storage device by the service unit would be removed again as part of a new work order and used for a cross-wound package/empty tube doffing.

If an empty tube is positioned in the storage device of the service unit and a corresponding work order for a cross-wound package/empty tube doffing comes in from a workstation that is processing the lot that uses this type of empty tube, it is advantageous if the empty tube is removed from the storage device by the gripping device positioned in the service unit and used for the cross-wound package/empty tube doffing.

In particular, the empty tube inserted into a storage device by the service unit is removed manually.

Alternatively, it is also conceivable that the empty tube positioned in the storage device is removed by an operator, so that the storage device is available for a new empty tube to be inserted into it again.

A second aspect of the invention therefore comprises a spinning machine producing take-up packages with a large number of workstations and at least one service unit that can travel between the workstations to process work orders regarding cross-wound package/empty tube doffing at the individual workstations, whereby an empty tube can be delivered to the service unit via the machine's tube feed track and the service unit has a gripping device with which the delivered empty tube can be removed from the tube feed track, and whereby the service unit has a control unit that is connected with a central control unit, which is in turn connected to the workstation control units.

The spinning machine producing take-up packages is characterized in that the control unit or central control unit are designed so that in the event that the work order for a cross-wound package/empty tube doffing expires before it is executed by the service unit and the empty tube is doffed, the service unit is controlled so that the empty tube removed from the tube feed track by the service unit can be put into a tube holder, and that then a new empty tube that is suitable for another lot can be removed from the tube feed track, in order to carry out a cross-wound package/empty tube doffing at another workstation processing one of the other lots.

With this design, if the current work order for carrying out a cross-wound package/empty doffing, for example due to a stoppage or a manual intervention, is deleted before the empty tube could be exchanged in the affected workstation, the service unit can be controlled according to requirements. This can even be realized during the cross-wound package/empty tube doffing cycle, i.e. any time before the empty tube is inserted into the package cradle, including for example after the full cross-wound package was already removed from the package cradle. The service unit is controlled in this context so that the empty tube removed from the tube feed track by the service unit using a gripping device is released again. In this context it is irrelevant for the invention how the gripping device of the service unit is designed, whether it is designed, for example, with gripping elements or with a pneumatic cylinder; the essential thing is that the service unit has a device by means of which the empty tube can be taken from the tube feed track.

If the service unit is no longer blocked by an empty tube that it cannot currently exchange, this service unit can process further or additional work orders, including in particular work orders regarding a cross-wound package/empty tube doffing at workstations that are processing another lot and accordingly use another type of empty tube. Unnecessary stoppages of the individual service units as well as the workstations waiting on a cross-wound package/ empty tube doffing are thus reduced. Finally, this has a positive effect on overall machine efficiency.

More advantageously, tube uptake is designed to occur via the tube feed track or a storage device for storing the empty tubes.

In this context it is conceivable in the framework of the invention that the empty tubes are released either back onto the tube feed track or that the empty tubes are stored in a storage device positioned either inside or outside of the service unit.

Further features and advantages of the invention are evident from the following description of preferred embodiment examples of the invention, on the basis of the figures and drawings illustrating details essential to the invention, and from the claims. The individual features can be implemented individually or in any desired combination in a preferred embodiment of the invention.

BRIEF DESCRIPTION OF THE DRAWINGS

Preferred embodiment examples of the invention are explained in more detail below on the basis of the enclosed drawings.

DESCRIPTION OF THE PREFERRED EMBODIMENTS

Figure 1:
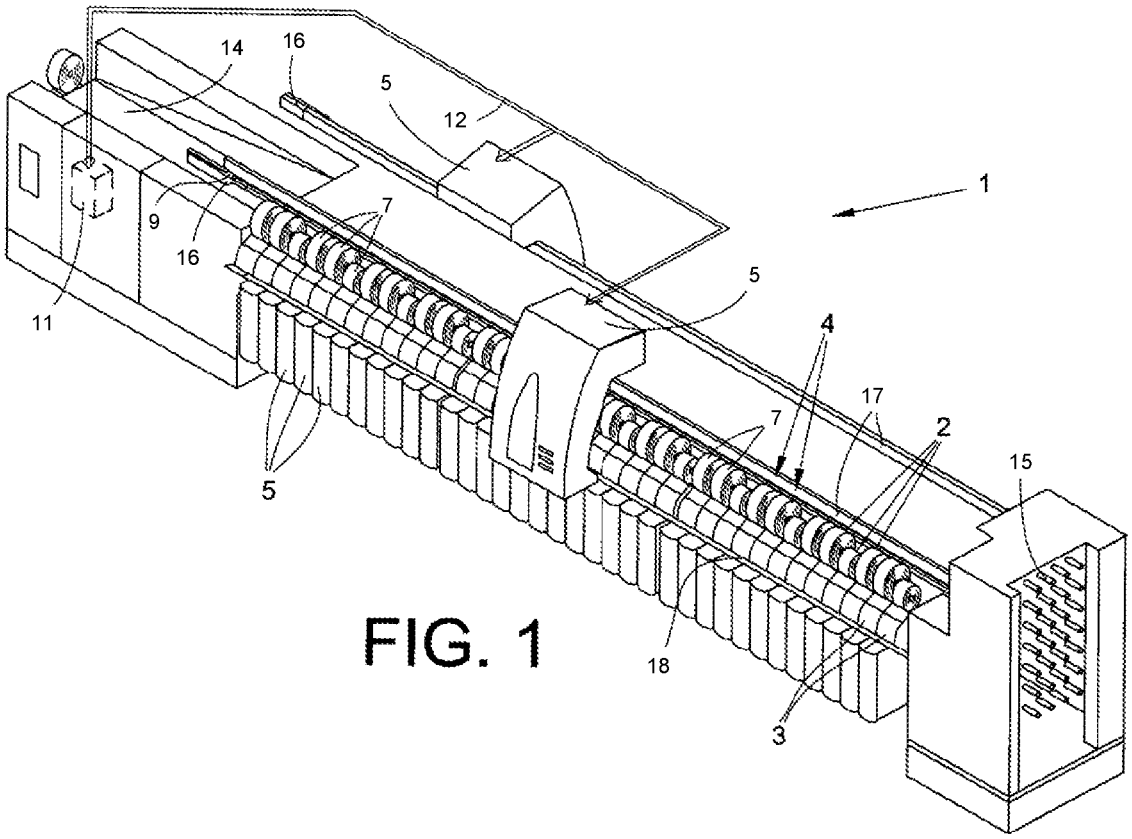
FIG. 1 illustrates an open-end spinning device with two travelling service units.

FIG. 1 shows a spinning machine 1 producing take-up packages, in this example designed as an open-end spinning machine, which has a large number of workstations 2, each fitted with a spinning device 3 and a winding device 4. The open-end spinning machine has in addition two identical service units 5.

Figure 2:
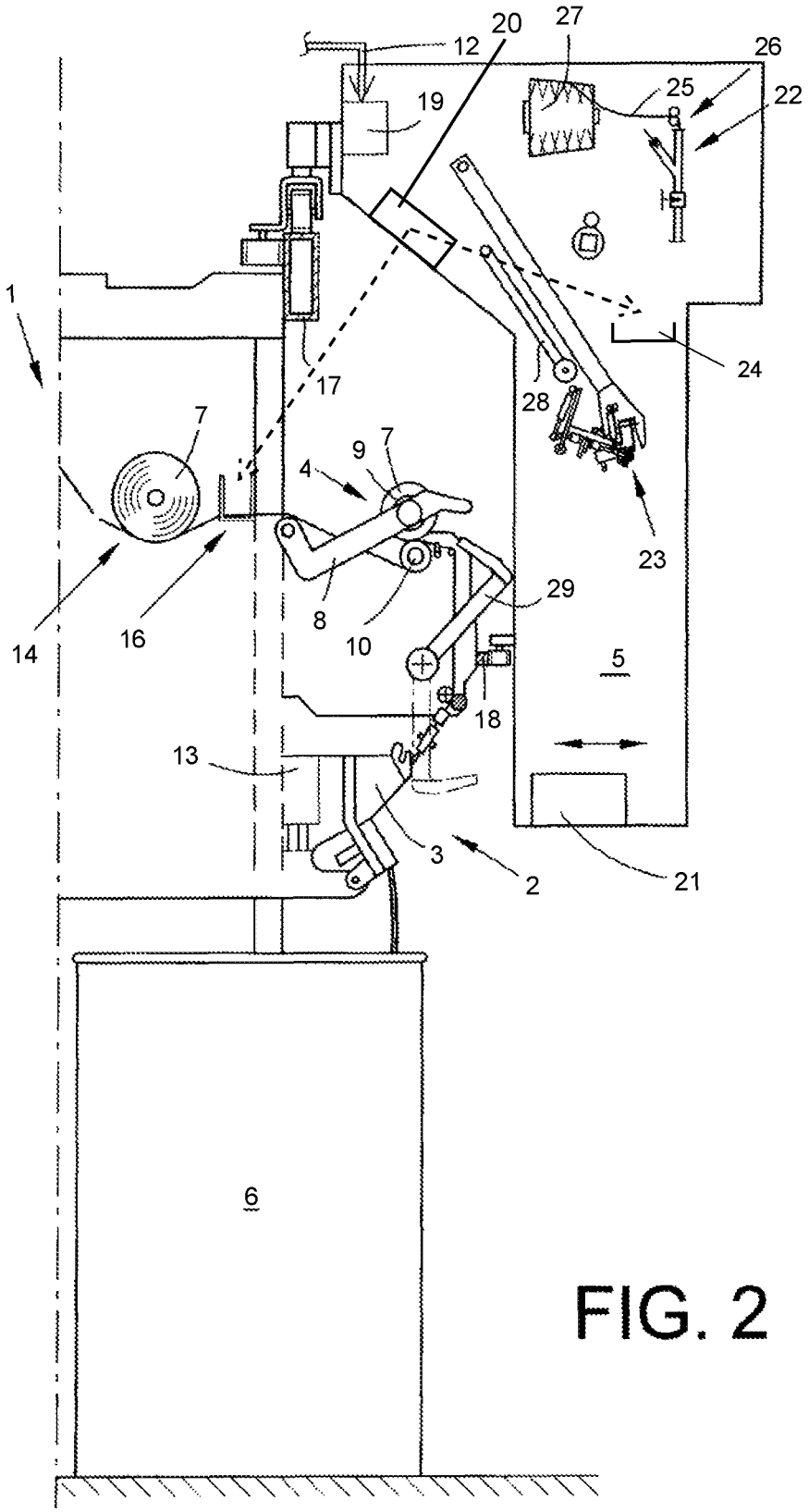
FIG. 2 illustrates a workstation of the spinning machine with a service unit positioned in front of it in side view.

In the spinning device 3 a sliver positioned in spinning can 6 is spun into yarn that is wound into cross-wound package 7 on the winding device 4. The winding devices 4, as depicted in FIG. 2, are fitted with a package cradle 8 for the pivotable holding of an empty tube 9 or a cross-wound package 7 as well as with a winding drum 10 for rotating these elements. The open-end spinning machine also has a central control unit 11 that is connected to the control units of the workstations 13 via a bus system 12. Moreover, such open-end spinning machines have a cross-wound package transportation device 14 for disposing of completed cross-wound packages 7 and an empty tube supply device which essentially consists of an empty tube magazine 15 as well as tube feed tracks 16.

The service unit 5 can travel along guide rails 17, 18 which are positioned at the open-end rotor spinning machine 1. The service unit 5 is depicted in more detail in FIG. 2. The control unit 19 of the service unit 5 is, like the workstation control units 13 and the central control unit 11, connected to the bus system 12 of the open-end spinning machine.

The service unit 5 has, as shown in FIG. 2, various handling devices which enable the service unit 5 to carry out a cross-wound package/empty tube doffing process if needed and thereby make a piecing yarn available to the spinning device 3 of the relevant workstation 2. Such a service unit 5 has, for example, a so-called (not shown) frame opener and a take-off and drive arm (also not shown) that can be positioned at the surface of the cross-wound package 7. The service unit 5 also comprises a gripping device 20, which is for example designed so that its gripping elements are adjusted to the external diameter of the empty tubes 9 that travel via the tube feed tracks 16 to the area of the workstations. Moreover, such a service unit 5 is also equipped with a device 21 for cleaning the spinning device 3, an auxiliary yarn delivery device 22 for preparing a piecing yarn as well as a yarn positioning and repositioning device 23. The service unit 5 can optionally also include a storage device 24. The empty tube 9, which is held in the gripping device 20 for an upcoming cross-wound package/empty tube doffing after expiry of the corresponding work order before it could be carried out, can be stored in this storage device 24. If the service unit 5 does not have a corresponding storage device 24, a no longer required empty tube 9 can be set back onto the tube feed track 16 again.

The service units 5 intervene themselves if there is a need for action at one of the workstations and this is signaled by a work order. Such a work order exists if the cross-wound package 7 is complete at one of the workstations 2 and must be exchanged for an empty tube 9. As soon as the service unit 5 is notified via the bus system 12 of the open-end spinning machine that there is a work order at one of the workstations 2, the service unit 5 travels to the affected workstation 2.

After the service unit 5 is correctly positioned, it exchanges the cross-wound package 7, which has reached its prescribed diameter, for an empty tube 9. This means that the service unit 5 transfers the completed cross-wound package 7 to the cross-wound package transportation device 14 after the package cradle 8 is opened using the take-off and drive arm and then doffs a new empty tube 9, which was made available to the service unit 5 via a tube feed track 16 from the empty tube magazine 15, using the gripping device 20 into the package cradle 8.

While the cross-wound package transportation device 14 is transporting the cross-wound package 7 to a transfer point located at the end of the machine, a piecing yarn 25 is prepared by the auxiliary yarn delivery device 22 of the service unit 5. Then the piecing yarn 25 is pulled through a yarn delivery unit 26 from a storage package 27 and transported pneumatically via a pivot-mounted delivery tube 28 into the area of a workstation's suction nozzle 29, represented in FIG. 2, which sucks up the yarn end. Then the delivery tube 28 transports the piecing yarn 25 into the area of a yarn positioning and repositioning device 23, which brings the piecing yarn 25 to the area of the empty tube 9 which is held in package cradle 8 of a workstation 2, whereby the free end of the piecing yarn 25 is transferred from the suction nozzle 29 to the workstation's (not shown) piecing tool, which prepares the yarn end as usual.

Figure 3:
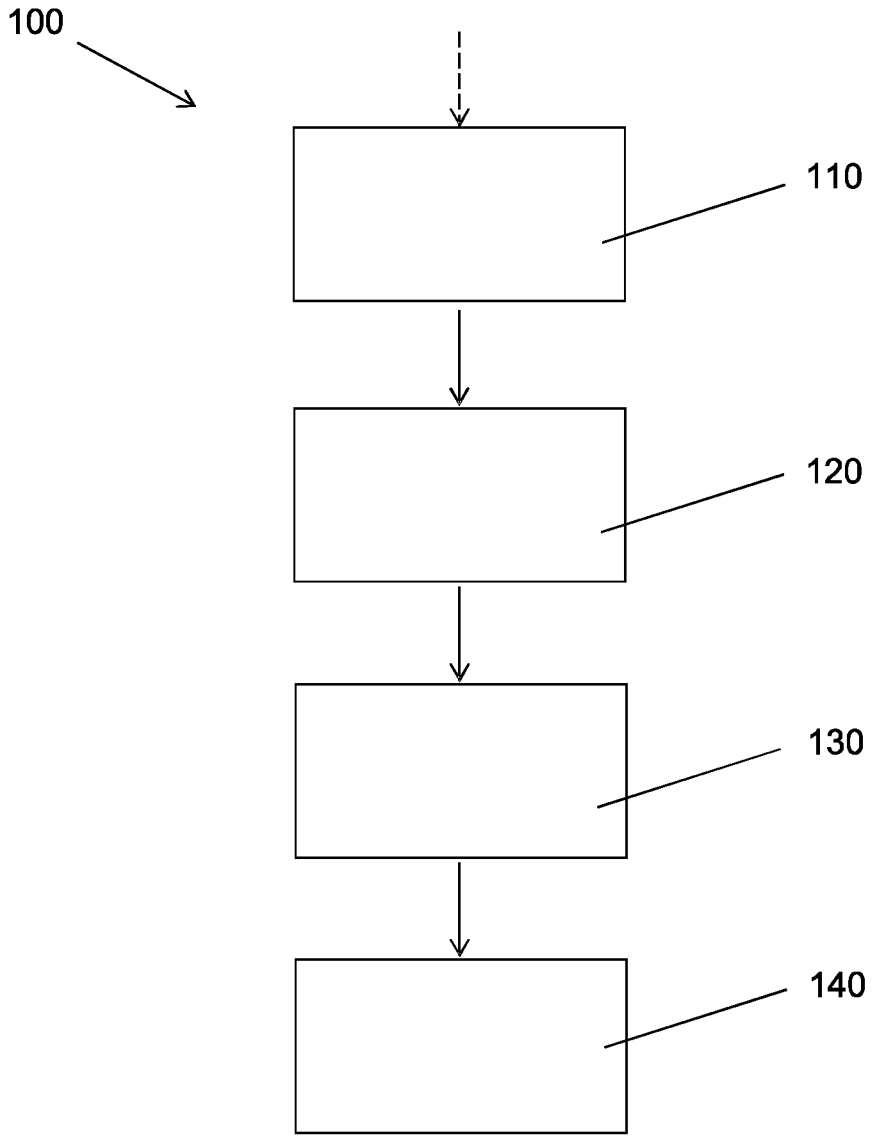
FIG. 3 illustrates a flowchart of the method.

The method 100 shown in the flow diagram in FIG. 3 involves the processing of work orders for a cross-wound package/empty tube doffing by a service unit 5 used at a spinning machine producing take-up packages.

After a work order is received from a workstation 2 the service unit 5 travels to the corresponding workstation 2 and in a first method step 110 an empty tube 9 is fed to the service unit 5 via the spinning machine's tube feed track 16. Then, in a second method step 120, the empty tube 9 is taken up by the service unit 5. Usually in this context the empty tube 9 is taken from the tube feed track 16 by a gripping device 20 positioned in the service unit 5. If the current work order expires, for which the empty tube 9 is positioned in the gripping device 20 of the service unit 5, before it could be changed, and if the next work order for another workstation 2 exists, which is processing another lot, the empty tube 9 which is already stored at the service unit 5 is released in a third method step 130. The no longer required empty tube 9 is put into a tube storage location, i.e. either set back onto the tube feed track 16 or stored in a storage device 24. In this way, the service unit 5 can accept a work order regarding a cross-wound package/empty tube doffing for another workstation 2 in a fourth method step 140, and take up the corresponding empty tube 9 from the tube feed track 16, even if the other workstation 2 is processing another lot and therefore requires another empty tube 9. In this way, the service unit can accept the next work order without unnecessary delay and can process subsequent requests from additional workstations 2.

LIST OF REFERENCE NUMBERS

1 Spinning machine that produces take-up packages
2 Workstation
3 Spinning device
4 Winding device
5 Service unit
6 Spinning can
7 Cross-wound package
8 Package cradle
9 Empty tube
10 Winding drum
11 Central control unit
12 Bus system
13 Workstation control unit
14 Cross-wound package transport device
15 Empty tube magazine
16 Sleeve feed track
17 Guide rail
18 Guide rail
19 Control device
20 Gripping device
21 Device
22 Auxiliary yarn delivery device
23 Yarn positioning and repositioning device
24 Storage device
25 Piecing yarn
26 Yarn delivery unit
27 Reserve package
28 Delivery tube
29 Suction nozzle
100 Method
110 First method step
120 Second method step
130 Third method step
140 Fourth method step It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A method for operating a service unit for processing work orders regarding a cross-wound package/empty tube doffing that is used at spinning machines producing
take-up packages, wherein said spinning machines process at least two different lots,
whereby in a first method step, a first empty tube of a first lot is fed to the service unit via a tube feed track of the spinning machine and
in a second method step, the first empty tube is taken up by the service unit,
characterized in that,
after a first work order for the cross-wound package/empty tube doffing for a first workstation expires before it the first work order is processed and after a second work order has been received, that is for a cross-wound package/empty tube doffing for a second workstation processing a second lot,
in a third method step, the first empty tube is released by the service unit, and
in a fourth method step the service unit takes up a second empty tube of the second lot, in order to be able to carry out a cross-wound package/empty tube doffing at the second workstation.

2. The method for operating a service unit according to claim 1, characterized in that the first empty tube released by the service unit is set back onto the tube feed track.

3. The method for operating a service unit according to claim 1, characterized in that the first empty tube released by the service unit is inserted into a storage device.

4. The method for operating a service unit according to claim 3, characterized in that the first empty tube inserted into the storage device by the service unit is removed again as part of a new work order and used for a cross-wound package/empty tube doffing.

5. The method for operating a service unit according to claim 3, characterized in that, the first empty tube inserted into the storage device by the service unit is manually removed.

6. A spinning machine producing take-up packages with a large number of workstations and at least one service unit that can travel between the workstations to process work orders regarding cross-wound package/empty tube doffing at the individual workstations, whereby a first empty tube of a first lot can be delivered to the service unit via a tube feed track of the spinning machine and the service unit has a gripping device with which the delivered first empty tube can be removed from the tube feed track, and whereby the service unit has a control unit that is connected with a central control unit, which is in turn connected to one or more workstation control units,
characterised in that,
the control unit of the service unit or the central control unit is designed so that, in the event that the work order for a cross-wound package/empty tube doffing expires before it is executed by the service unit and the first empty tube is doffed, the service unit is controlled so that the first empty tube removed from the tube feed track by the service unit can be put into a tube holder, and that then a second empty tube of a second lot can be removed from the tube feed track, in order to carry out a cross-wound package/empty tube doffing at a second workstation processing the second lots.

7. The spinning machine producing take-up packages according to claim 6, characterised in that the tube holder is comprised of the tube feed track or a storage device for storing the first empty tube.

* * * * *